United States Patent [19]

Pedersen

[11] 4,275,904

[45] Jun. 30, 1981

[54] MONONOSE CONVERSION FOR TWINSKIS

[75] Inventor: Alec Pedersen, Vancouver, Canada

[73] Assignee: Pedersen Industries Ltd., Vancouver, Canada

[21] Appl. No.: 926,819

[22] Filed: Jul. 21, 1978

[51] Int. Cl.[3] .....A63C 5/00; A63C/11/00

[52] U.S. Cl. ..... 280/818; 280/12 F; 280/12 H; 280/601

[58] Field of Search ..... 280/11.37 E, 11.37 J, 280/12 F, 12 H, 11.37 R, 11.37 A, 609, 607, 601, 809, 818

[56] References Cited

U.S. PATENT DOCUMENTS

| | | | |
|---|---|---|---|
| 3,171,667 | 3/1965 | Wightman | 280/11.37 J X |
| 3,357,714 | 12/1967 | Kuehn | 280/11.37 E |
| 3,567,239 | 3/1971 | Kitterman | 280/11.37 E |

FOREIGN PATENT DOCUMENTS

| | | | |
|---|---|---|---|
| 223560 | 11/1942 | Switzerland | 280/11.37 J |

*Primary Examiner*—John J. Love
*Assistant Examiner*—Milton L. Smith
*Attorney, Agent, or Firm*—Fred Philpitt

[57] ABSTRACT

A mononose structure converts a pair of conventional skis into a twinski. The mononose structure is a tip which includes, a trailing portion of essentially the total width selected for the width of the twinski and a leading portion converging forwardly in a curved nose; a right-hand pocket to hold a conventional ski placed therein and a left-hand pocket to hold a conventional ski placed therein, the two pockets being separated by a central bridge section, and means cooperating with and associated with the mononose and with the pair of conventional skis for clamping the tips of conventional skis rigidly thereto. This provides the forward end of a twinski having an upwardly curved tip and bifurcated tail sections separated by a longitudinal slot. The rear ends of the conventional skis are tied together by tail bridge means at the tails of each of the conventional skis. This tail bridge means adjustably and floatingly holds the tails of the conventional skis in a predetermined, spaced-apart relation so that the lateral spacings are predetermined, but yet the tails are permitted to move vertically. The twinski thus provided has extremely good maneuverability, good pivot turnability, controlled turns at substantially all speeds, good support on powder snow and excellent manoeuverability in both packed and corn snow. The four edges provide greater control and the interconnected tail section work independently.

15 Claims, 28 Drawing Figures

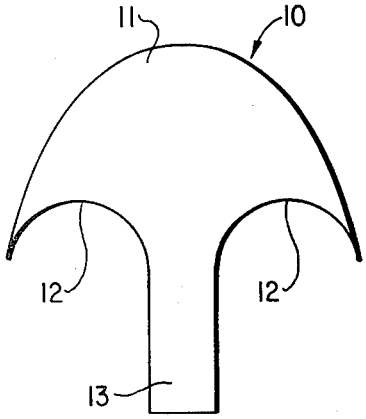
FIG. 1
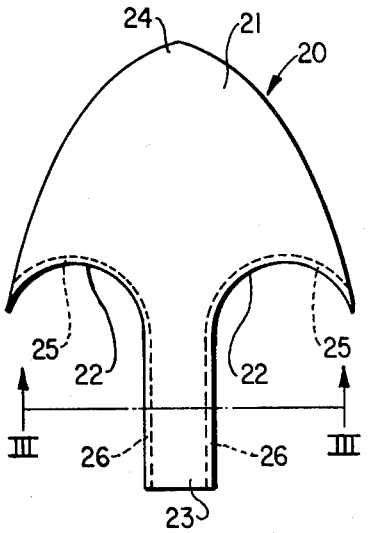
FIG. 2
FIG. 3
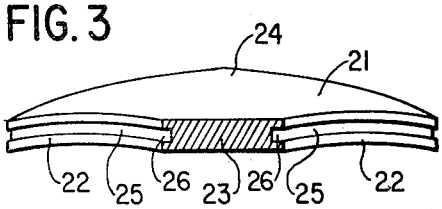
FIG. 5
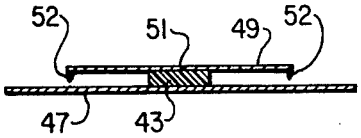
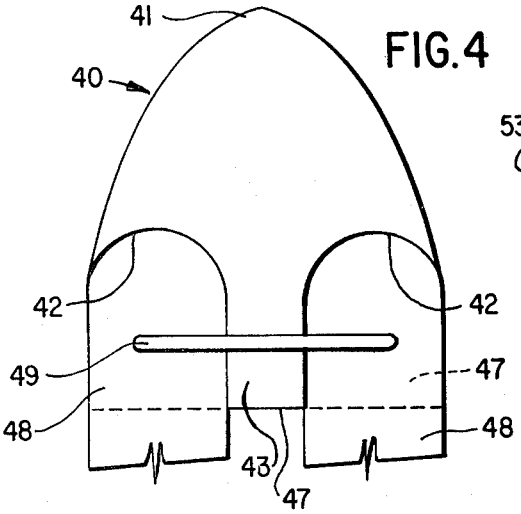
FIG. 4
FIG. 6
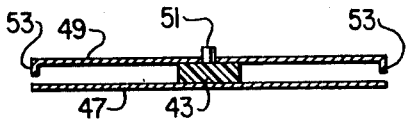
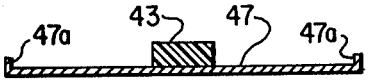
FIG. 7

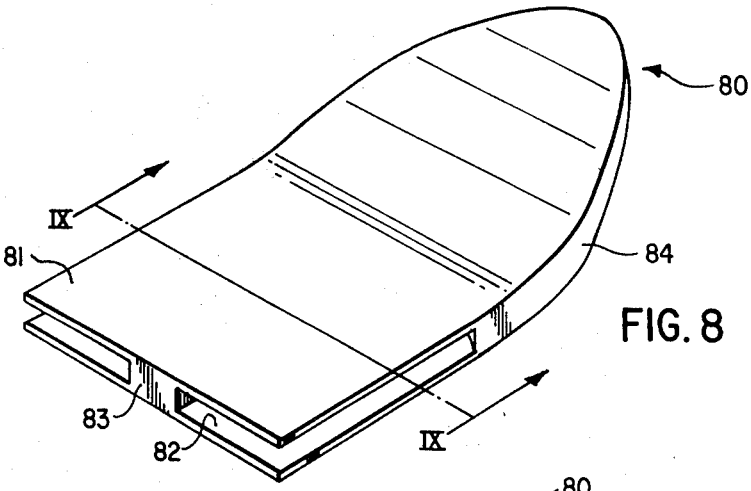
FIG. 8
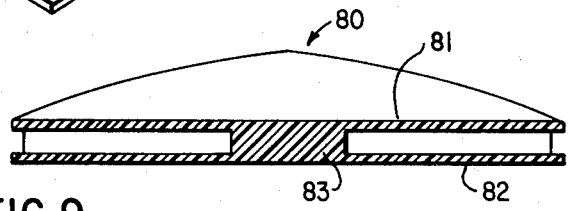
FIG. 9
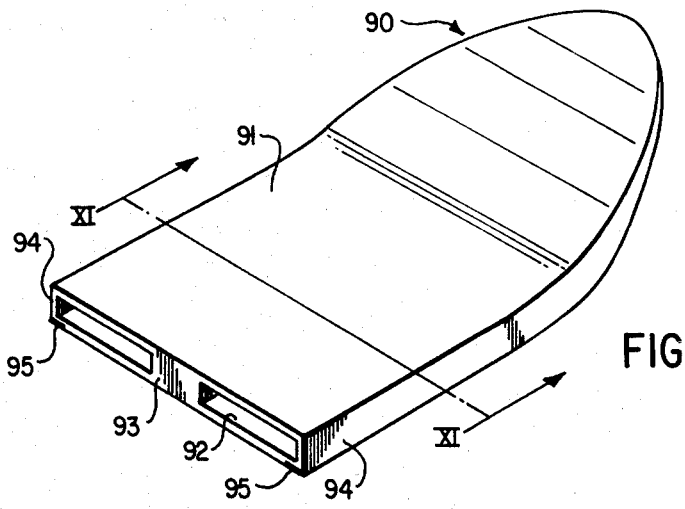
FIG. 10
FIG. 11
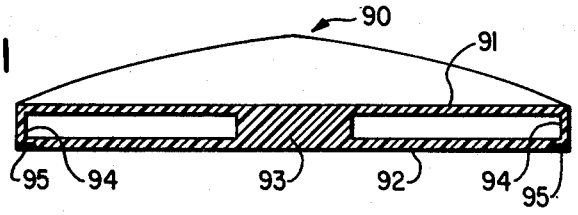

MONONOSE CONVERSION FOR TWINSKIS

BACKGROUND OF THE INVENTION

1. Field of the Invention

This invention relates to means for providing a single ski which is adapted to support both feet of a skier, the single ski including means for securing both feet or boots of the skier directly over the ski and alongside each other.

Many skiing accidents result from crossed or diverging skis, with or without proper bindings. Accordingly efforts have been devoted to developing so-called monoskis because it was felt that the likelihood of injury would be reduced because the legs would be held on a single, wide ski fairly close together.

2. Description of the Prior Art

Examples of such monoskis are shown in the following patents, namely: U.S. Pat. No. 3,154,312 patented by Jacques Marchand on Oct. 27, 1964; U.S. Pat. No. 3,685,846 patented by Hans Schmid on Aug. 22, 1972; and U.S. Pat. No. 3,758,127 patented by Michael D. Doyle and William L. Bahne, on Sept. 11, 1973.

While monoskis as above described were useful in powder snow, they were most difficult to control and to use in hard-packed or corn snow. In an effort to provide a new and improved single ski on which both feet were be held in close side-by-side relation, which was easily controlled and was safer to use then conventional dual skis, not only in powder snow, but also in hard packed or corn snow, the monoski of Canadian Pat. No. 989,435 issued May 18, 1976 to Alec Pedersen, was developed.

While the monoski described in the above identified Canadian Patent was superior to monoskis proposed in the past, it was found desirable to effect further improvements namely, to provide a modification of conventional skis to provide a monoski.

On such modification was provided in U.S. Pat. No. 3,802,714 patented by Stephen D. Freegard on Apr. 9, 1974. In that patent a deck structure was provided which could be added to one of a conventional pair. of skis so that the single ski could be used as a monoski. Thus, the deck structure included a two-part pedestal, the parts of which were relatively reciprocable in one vertical plane of the pedestal, and adapted to be superposed on a ski and interengaged with the bindings thereof. The deck structure also included a two-part platform which was mounted on the pedestal to support the skier. The parts of the platform were also relatively reciprocable in the vertical plane of the pedestal, so that the binding on the parts of the platform, adjacent the upper surface thereof could be interengaged with the boots of the skier. When the parts of the pedestal were interengaged with the bindings of the ski, the parts of both the pedestal and the platform were fixed in relation to one another. However, it was also taught that the parts of the platform should be relatively reciprocable in conjunction with the parts of the pedestal, and vice versa, automatically to transfer the functional relationship between the bindings of the ski, to the binder means on the parts of the platform.

SUMMARY OF THE INVENTION

Aims of the Invention

Accordingly, objects of this invention include the provision of means for converting skis to an improved twinski which includes wide stance for balance, is adaptable to virtually all snow conditions, is lighter in overall weight and is easier and safer to use than the conventional skis.

Suggestions were made to connect a pair of conventional skis together by the use of fore and aft metallic cross-strips which were rotatably secured at their ends to the skis, so as to act as a parallelogram connection. This was not satisfactory since, when one ski moved, the skis either came closer to one another, or spread further apart. Consequently if balance were lost, it could not readily be recovered, due to the fact that the skis became locked at a distance apart which was not suitable for regaining stability in some maneuvers. Furthermore vertical cross-straps became loosened or broke, and there was no edge control.

Minor improvements in such connectors were suggested by providing ball-and-socket connectors. However, because fore and aft movement resulted in closure, balance was critical. While vertical movements were now possible, the monoski was unstable and edge control was inadequate.

The suggestion to provide the cross-members as "X" connectors was not entirely satisfactory, even with ball-and-socket joints, since the skis came together, resulting in a loss of balance. This problem was overcome by welding the intersection of the "X" while retaining the ball and socket joint at the skis. However, the high stress built-up during use resulted in frequent breakage.

It was then proposed to secure the tips a fixed distance apart by the use of a pair of hinges. One end of each hinge would be secured to its one associated ski, and the other end of each hinge would be secured together by a plate. It was thought that such hinges would permit rotation of the skis about longitudinal axes to allow full edge contact while holding the ski tip at a fixed distance. However, the free vertically pivoted movement did not provide sufficient opposed flexing to allow full and adequate edge control. Furthermore, it was found that the connected ski had relative rotation between the individual skis and fore and aft movement of the skis was permitted. This reduced edge control. It was also proposed to overcome the problem of excessive rotation and fore-and-aft movement by the provision of flexing limiting devices. However, the problem of edge control was not always entirely solved.

As well as the hinge means to hold the tips of the conventional skis together it was necessary to hold the tails of the conventional skis a fixed distance apart. One proposal was to use hinges secured at one end to the respective ski and at the other end to finned interlocking means similar to bicycle chain. This was not entirely satisfactory as there was too little resistance to relative vertical and rotational movement between the tails of the conventional skis to provide stability. It was believed that the tails could be held together by a strap means that would separate the skis and restrict outward movement of the tails of the skis while permitting resistive vertical movements.

One suggestion was a strap of metal or plastic material which was adapted to be held by the ski bindings or the ski boots of the skier.

Accordingly it is a broad object of this invention to provide conversion means for connecting a pair of conventional skis together to provide a twinski having the desirable and useful qualities of a monoski.

(ii) Statements of Invention

By broad principles of this invention, a tip connector is provided in which the bottom of the connector comes tangentially into contact with the point of contact of the conventional skis with the snow, in which the connector secures the ski tips together to maintain the ski tips apart by the same distance as a tail bridge that maintains the ski tails a fixed distance apart while permitting restricted torsional movement of the tails of the skis.

Thus, by this invention a tip structure is now provided, for converting a pair of conventional skis into a twinski, the tip structure comprising: a mononose section including a trailing portion of essentially the total width selected for the width of the twinski and a leading portion converging forwardly in a generally curved nose; a right-hand pocket and a left-hand pocket separated by a central bridge section; the right-hand pocket having at least a lateral outside surface defined by a forward web section adapted to conform and butt against the outside edge of the tip of a conventional ski placed in the right-hand pocket, and having an inside edge of the central bridge section adapted to conform and butt against the inside edge of the tip of a conventional ski placed in the right-hand pocket; the left-hand pocket having at least a lateral outside surface defined by a forward web section adapted to conform and butt against the outside edge of the tip of a conventional ski placed in the left-hand pocket, and having an inside edge of the central bridge section adapted to conform and butt against the inside edge of the tip of a conventional ski placed in said left-hand pocket; and means, cooperating with and associated with the mononose and with the pair of conventional skis for clamping the tips of the conventional skis rigidly to the mononose.

The present invention also provides, in combination with a tip structure for converting a pair of conventional skis into a twinski, as described above, bridge means secured to, and joining the tail sections of a pair of conventional skis together, such bridge means at the tails adjustably and floatingly holding the tail segments in predetermined spaced apart relation so that lateral spacings are predetermined, but yet the tails are permitted to move vertically, thereby converting the pair of conventional skis into a twinski.

(iii) Other Features of the Invention

By yet another feature, the tip structure is in the form of a base plate and an upper plate superposed on, secured to and conforming in size to the base plate.

By still another feature, the tip segment, central bridge, base plate and upper plate are integral.

By a further feature, the upper plate and the base plate are joined along their outside edges by an edge section.

By a further feature, the mononose includes friction means along the inner surfaces of the upper and base plates to assist in retaining the tips of the conventional skis therein.

By a further feature, the upper plate is secured to the base plate after the skis have been placed in the pockets.

By another feature, the tip structure includes a pivotal arm secured to the bridge section of said base plate and adapted to be turned to hold the tip of the conventional skis onto the pockets prior to having the upper plate secured to the base plate.

By yet another feature, the structure includes pins projecting through aligned apertures in the base plate, the conventional skis and the upper plate, and means to retain the pins in position, thereby to secure the conventional skis to the mononose.

By still another feature, the structure includes screws securing the conventional skis to the mononose.

By a further feature, the mononose includes steel edges along the outer edges of the base plate.

By another feature, the mononose is formed of high impact plastics material, e.g. injection molded polyurethane.

By another feature, the mononose is formed of a light weight strong metal, e.g. aluminum.

(iv) General Description of the Invention

The length of the longitudinal slot, i.e. the distance from the end of the central bridge section of the mononose to the end of the tails of the conventional skis is dependent, to some extent, upon the snow the twinski is adapted to be skied upon. For use in powder snow, the slot is generally shorter than one which is to be used in hard packed snow.

The mononose section must be made of exceptionally strong material e.g. a metal, for example, aluminum, in order to withstand the stress built up on the twinski due to the twisting action at the tail segments. Such twisting action is inherent in the "setting" of the edges of the monoski during skiing. Thus, it is essential that the tip be made very strong in order to avoid breakage. It is thus preferred that a mononose formed of metal, be of a length of at least 50 cm.

In a twinski to be used in hard packed snow, it is preferred that the slot converge as it approaches the mononose and that the slot be longer. The length of the slot can be varied depending on the material used in the mononose. Thus, for more flexible material, the slot need not be as long in order to provide a twinski which can twist under skiing conditions to "set" the edges.

For a monoski to be used in powder snow the slot converges towards the mononose. The slot extent is shorter than that used for hard packed snow.

BRIEF DESCRIPTION OF THE DRAWINGS

In the accompanying drawings,

FIG. 1 is a top plan view of one embodiment of a mononose conversion structure;

FIG. 2 is a top plan view of another embodiment of a mononose conversion structure;

FIG. 3 is a cross-section along the line III—III of FIG. 2;

FIG. 4 is a top plan view of yet another embodiment of a mononose conversion structure showing a pair of conventional skis secured in the mononose;

FIG. 5 is a schematic cross-sectional view of one version of a transverse retaining rod for use in a mononose conversion structure of an aspect of this invention;

FIG. 6 is a schematic cross-sectional view of a second version of a transverse retaining rod for use in a mononose conversion structure of an aspect of this invention;

FIG. 7 is a schematic cross-sectional view of a bottom plate used with the mononose structure of FIG. 4;

FIG. 8 is a perspective view of another embodiment of a mononose conversion structure;

FIG. 9 is a cross-section along the line IX—IX of FIG. 8;

FIG. 10 is a perspective view of yet another embodiment of a mononose conversion structure;

FIG. 11 is a cross section along the line XI—XI of FIG. 10;

DESCRIPTION OF PREFERRED EMBODIMENTS

(i) Description of FIG. 1

Figure 12:
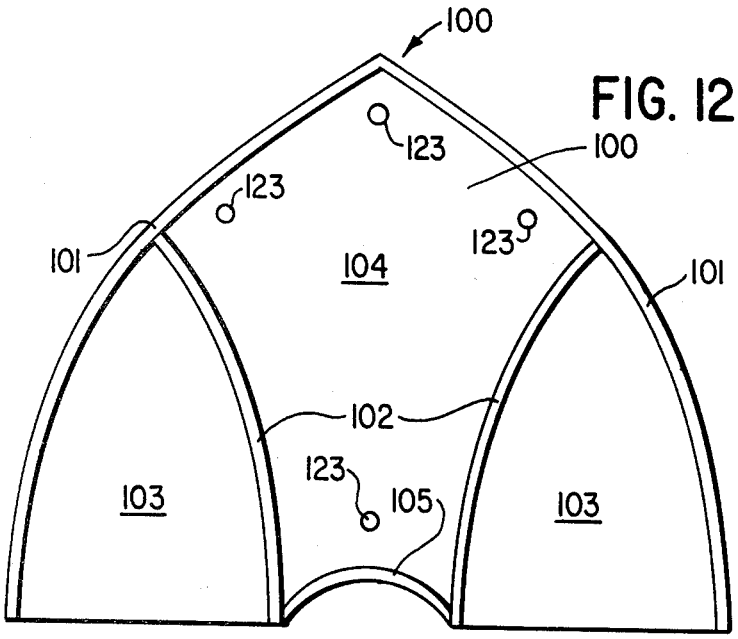
FIG. 12 is a top plan view of one variant of a bottom plate component of another embodiment of a mononose conversion structure.
Figure 13:
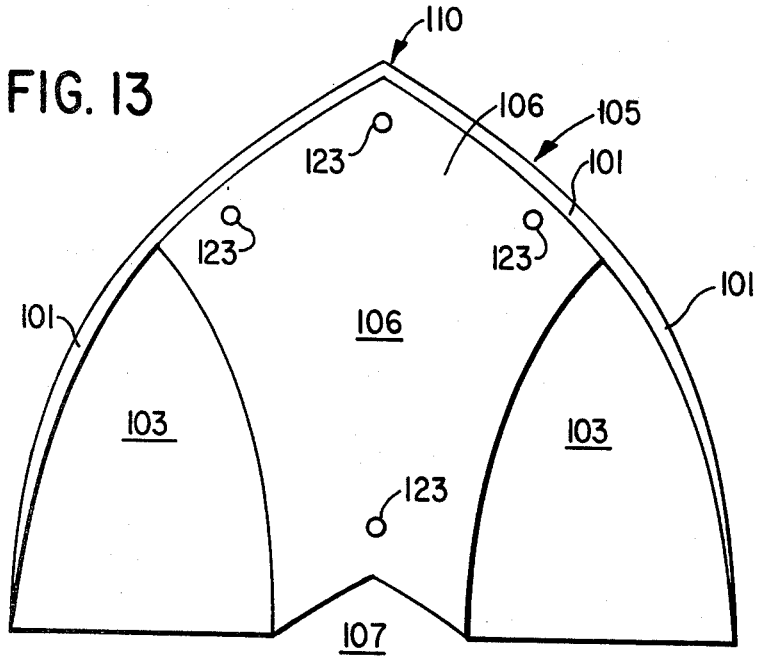
FIG. 13 is a top plan view of another variant of a bottom plate component of yet another embodiment of a mononose conversion structure.

FIG. 1 shows one version of a mononose conversion structure of one variant of this invention. As one of the basic principles of this invention, it is important that the mononose be upwardly curved and that the bottom plate thereof merge tangentially to the contact point of the skis on the snow. As seen in FIG. 1, the mononose or tip structure 10 includes a forward tip region 11 whose edge-to-edge width is essentially that selected for the width of the twinski. The forward tip region includes a pair of trailing nest sections 12. Disposed between the two trailing nest sections 12 is a central bridge section 13, the width of which is selected to be the longitudinal spacing between the conventional skis. In one version, the spacer or central bridge section is adapted to keep the skis apart at the tip the same distance as the tail bridge (to be described later) although it is within the ambit of the invention that the spacing at the tip may be less than that at the tail.

(ii) Description of FIGS. 2 and 3

The embodiment of the mononose conversion structure 20 shown in FIGS. 2 and 3 differs from the embodiment of FIG. 1 in several respects. In the first place, it is noted that the forward tip region 21 has a more pointed tip 24. Furthermore the exposed edges of the trailing nest section 22 are provided with grooves 25, and the lateral edges of the tail section 23 are also provided with grooves 26. The tips of conventional skis (not shown) are inserted in the grooves 26 and 25 so that they nest in the trailing nest sections 22 with their outside edges exposed to provide the outer ski edges. While not shown, it is essential to provide means to maintain the pair of conventional skis securely fixed to the mononose even in spite of the torsional forces applied to the converted monoski. Several versions and embodiments of such means will be described hereinafter.

(iii) Description of FIGS. 4–7

As seen in FIG. 4, the mononose conversion structure 40 includes a forward tip 41, a pair of trailing nest sections 42 and a central bridge section 43. Disposed below and secured to the tip structure 40 is a base plate 47, extending rearwardly to the rear extension of the central bridge section 43. A pair of conventional skis 48 is secured to the tip structure 40 by placing the skis on the base plate 47, and nesting the ski tips within the trailing nest section 42. The ski tips are maintained securely fixed to the mononose 40 by transverse retaining bar 49.

Two versions of such retaining bar are shown in FIGS. 5 and 6. In FIG. 5, a central pin 51 secures the bar 49 to the central bridge section 43. The bar 49 may be provided with terminal depending pins 52. These pins may be urged downwardly to come into frictional contact with the tops of the skis 48. Alternatively the skis 48 may be provided with dead end holes (not shown) into which pins 52 are urged.

As seen in FIG. 6, the bar 49 is wide enough to extend to the outer edge of the skis 48. The bar 49 is provided with downturned edges 53. By one variant, the bar 49 is one piece and is of sufficient length to secure the tips of the skis 48 together by urging the ski tips together under the downturned edges, and then allowing the ski tips to flex outwardly to their normal position.

By another variant, (not shown) the bar 49 is formed of two segments, with, for example a slot therein. The length of the bar can be adjusted until the downturned edges contact the edges of the skis 48. Then the bar is urged downwardly to secure the skis to the tip section.

By yet another variant (again not shown) the two segments are held together by a tension spring which holds the ski-tips together by engagement of the downturned edges of the bar with outside edges of the ski tip. The spring is such as normally to maintain the downturned edges close together.

FIG. 7 shows a variant of the base plate 47. In this variant, the base plate 47 has upturned retaining edges 47A.

(iv) Description of FIGS. 8 and 9

Another variant is shown in FIGS. 8 and 9. In this variant the mononose 80 is formed of a rigid, molded or ast synthetic plastics material, e.g. polyethylene, polyinyl chloride, nylon, etc to have the upper plate 81 oined to the lower plate 82 through a central bridge ection 83. The total width of the upper and lower lates 81, 82 is selected to be the width of the twinski. 'he width of the bridge section 83 provides the spacing etween the tips of the two conventional skis. The pper plate 81 and the lower plate 82 are provided with n upper curvature, corresponding to the curvature at he tips of the conventional skis. To help maintain the onventional skis within the monose 80, a forward web 4 interconnects the upper plate 81 and the lower plate 2 at the forward tip extremity.

Description of FIGS. 10 and 11

Yet another variant is shown in FIGS. 10 and 11. Iere, as in the variant of FIGS. 8 and 9, the mononose 0 is formed of a suitable synthetic plastics material vhich may be rigid, and be molded or cast, or may be lexible but torsionally strong to embrace the ski tips. 'he mononose 90 has the upper plate 91 joined to the ower plate 92, not only by a central bridge section 93, ut also by lateral web sections 94, web sections 94 xtending around the side edges and the forward tip vhile leaving the trailing edge open. The total width of he upper and lower plates 91, 92 is selected to be the vidth of the twinski. The width of the central bridge ection 93 provides the spacing between the tips of the wo conventional skis, (not shown). The upper and ower plates 91, 92, are provided with a suitable curvaure to correspond with the curvature of the tips of the onventional skis. Alternatively, if the mononose is lexible, the mononose assumes the curvature of the onventional ski tips. The tips of the conventional skis re held within the pockets defined by the upper plate 1, the lower plate 92, the central bridge section 93, and he lateral web sections 94. At the lower edges of the entral bridge section 93 are a pair of steel running dges 95.

(vi) Description of FIGS. 12–15

FIGS. 12–15 show other variants of this invention. 'IG. 12 shows one embodiment of a bottom plate 100. 'he bottom plate 100 is made of any suitable strong naterial, either a synthetic plastic material e.g. polystyene, nylon, etc. or metal e.g. aluminum, magnesium tc. or any laminated material e.g. glass fibres, etc. conentionally used for making skis. Of course, it has a urvature to match the curvature of the tips of conveniional skis. The outer periphery of the forward tip of the ottom plate is provided with a wall 101 which does not xtend across the trailing edge thereof. This permits a ki to be slipped in or onto restricted portions of the ottom plate 100. A pair of internal spacer walls 102 is rovided to match the outline of the tip of a conveniional ski. The lateral spaces 103 provide nesting areas or the tips of the conventional skis. The internal space 04 between outer wall 101 and the spacer walls 102 is eft hollow or unfilled, and this provides light weight or the mononose bottom plate 100. The trailing edge of nternal space 140 is provided with a trailing wall 105, o enclose the space 104 entirely.

The embodiment of the bottom plate 110 shown in 'IG. 13 differs from that shown in FIG. 12 in that the nternal space 106 is provided as cast or fabricated of lastics or foam material. This provides a cushion for he tips of the conventional ski to nest against without he need for the internal spacer walls 102 (FIG. 12). The outer limit of the ski tips is restrained by the outer walls 101. The bottom plate 100 is also provided at its trail-tail section with a central slot 107 to provide an apex for the slot to be provided by the spacing of the two conventional skis.

Figure 14:
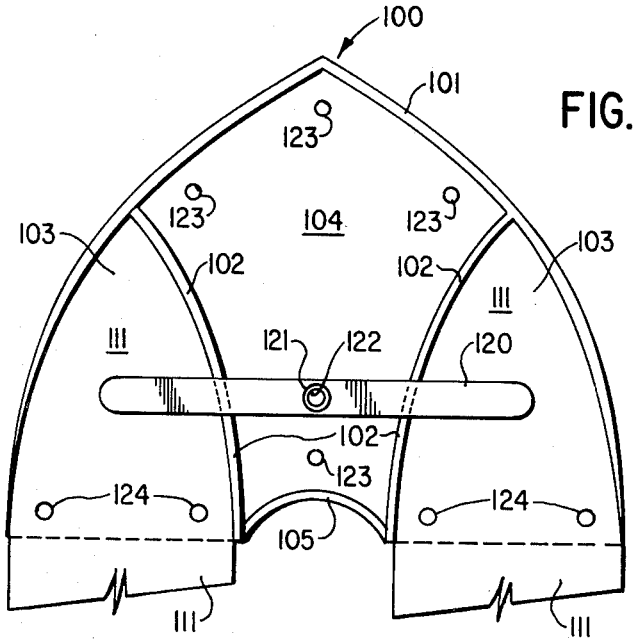
FIG. 14 is a top plan view of yet another variant of a bottom component of yet another embodiment of a mononose conversion structure.

FIG. 14 shows one embodiment of a structure to maintain the tips of the conventional skis within the mononose. The bottom plate may be the one shown in FIG. 12 or in FIG. 13, but, for simplicity, the variant shown in FIG. 12 will be described. The pair of conventional skis 111 is placed in the pockets 103 in the bottom plate 100. A swivel bar 120 is rotatably mounted on a hollow shaft 121 to extend across the skis 111. The shaft 121 is provided with a central internally-threaded hole 122. This is to accommodate the threaded end of screw 114. (see FIG. 16) It will also be observed that the bottom plate 100 is provided with blind, internally threaded rivets 123 to accept the threaded ends of screws 113. Alternatively, the skis 111 may be provided with blind, internally threaded rivets 124 to accept the threaded ends of screws 113A.

Figure 15:
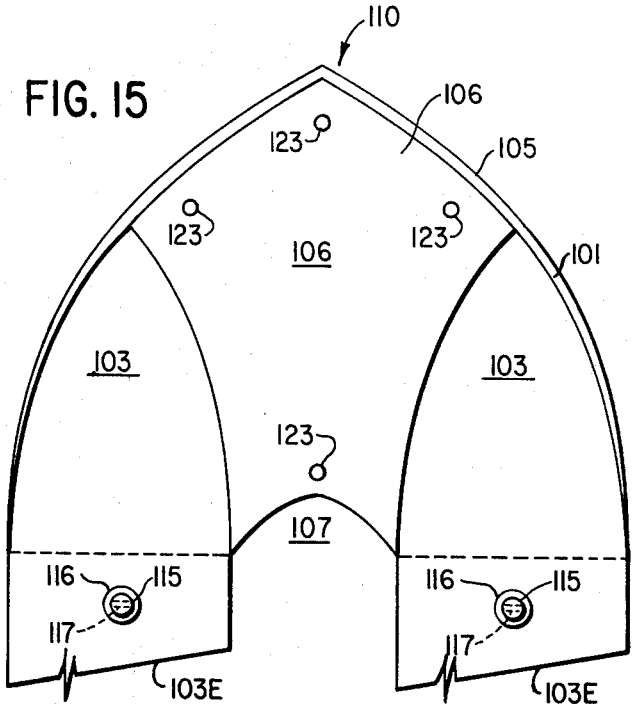
FIG. 15 is a top plan view of yet another variant of a bottom plate component of yet another embodiment of a mononose conversion structure.

FIG. 15 shows another embodiment of a structure to maintain the tips of the conventional skis within the mononose. While the bottom plate may be the one shown in FIG. 12 or in FIG. 13, for simplicity the variant shown in FIG. 13 will be described. The bottom plate 110 includes a pair of rear extensions 103E of the ski-accommodating pocket 103. Each extension is provided with an upstanding pin 115 integral with a base 116 secured to the extension 103E. Pin 115 is provided with a through-hole 117, whose purpose will be described hereinafter with respect to FIG. 17.

Figure 16:
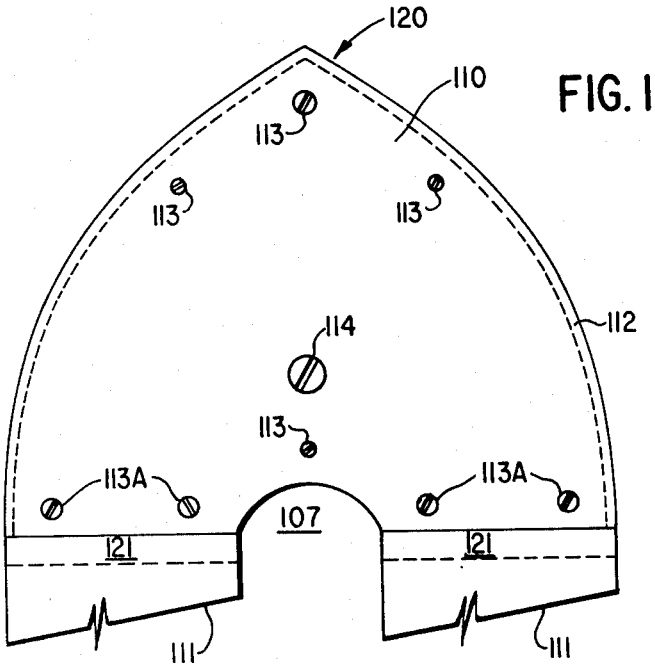
FIG. 16 is a top plan view of one variant of a top plate component of an embodiment of a mononose conversion structure which may be used with variants of the bottom plate.

FIG. 16 shows the configuration of one variant of the top plate 120. The top plate 120 is as wide as the bottom plate but may be the same length or slightly longer to provide a small overlap area 121 (if desired). The upper plate includes a downturned edge 112 which may be provided either on the inside or on the outside of edge 101 of the bottom plate. The upper plate 120 may then be secured to the lower plate 110 of FIG. 12 or 110 of FIG. 13 by the use of screws 113 which screw into blind nuts 123 and/or screws 113A which screw into blind nuts 124. If the lower plate is the one shown in FIG. 14, then a large screw 114 is also provided, which screws into the central tapped aperture 122 of shaft 121.

Figure 17:
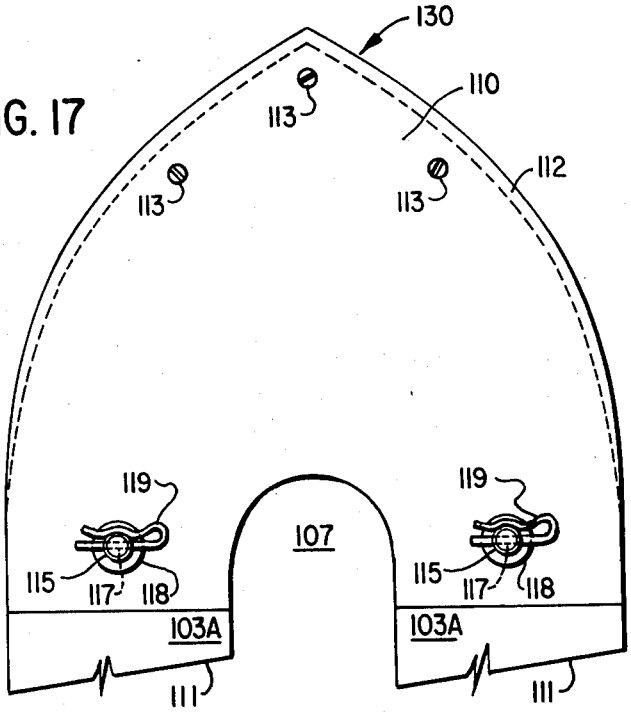
FIG. 17 is a top plan view of another variant of a top plate component of an embodiment of a mononose conversion structure which may be used with the bottom plate structure of FIG. 15.

As seen in FIG. 17, the conventional ski is provided with an aperture (not shown) to permit pin 115 to pass therethrough and the skis are then placed in pockets 103 with the pins 115 projecting therethrough. The upper plate 130 is provided with a rear extension 103A, which is provided with mating apertures 118. When the upper plate 130 is then placed thereover, the pin 115 projects through aperture 118. When a latch pin 119 is forced into through-hole 117 to hold each conventional ski 110 in place.

Figure 18:
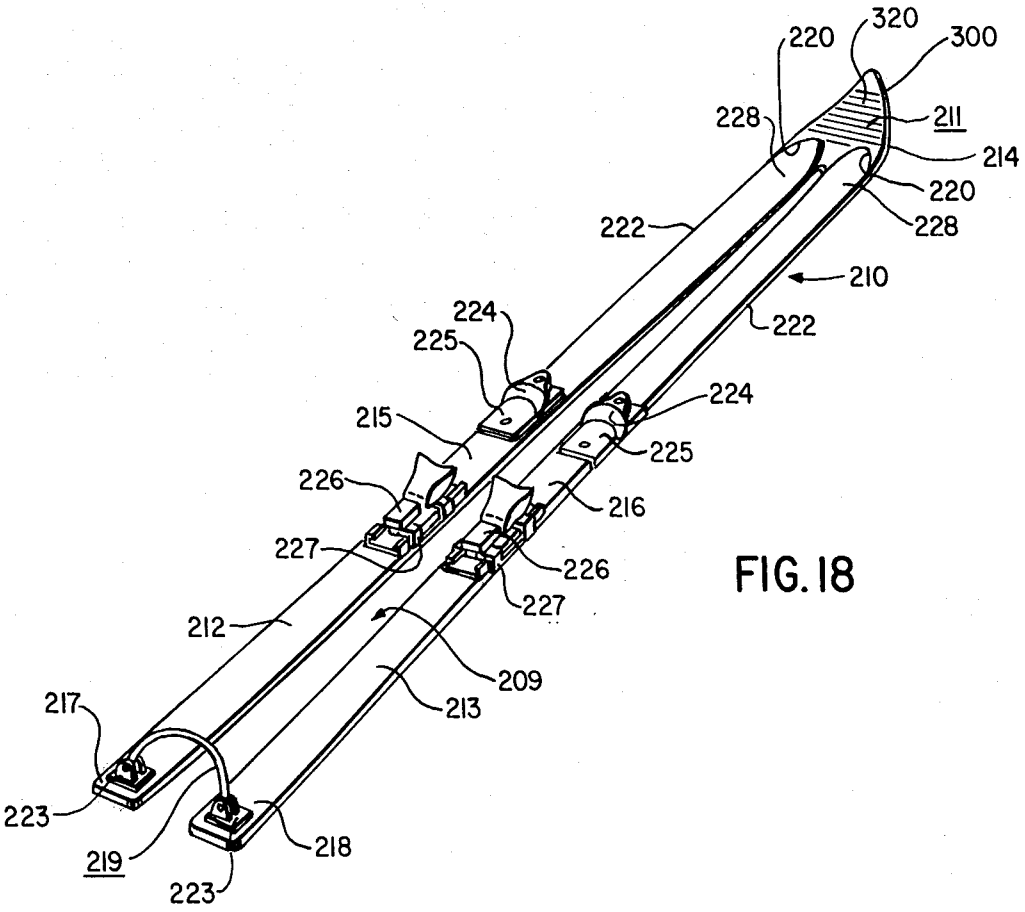
FIG. 18 is a perspective view of a twinski showing the mononose conversion structure, a pair of conventional skis in place, and a bridge unit, and shown partly in section.

(vii) Description of FIG. 18

Turning now to FIG. 18, it is seen that the twinski 210 comprises a mononose 211 and a pair of conventional skis 212 separated by a slot 209. The twinski 10 includes an upwardly curved forward tip region 214 and a pair of tail segments 217, 218 providing the tail portion. The tail segments 217, 218 of the conventional pair of skis are tied together in a "floating" manner to be described hereinafter by tail bridge structure 219. The tips of the conventional skis 12 are inserted into the pockets 20 in the mononose 211. The tips of the skis are thus enclosed on the bottom by a bottom plate 300 and on the top by a top plate 320. The two conventional skis are spaced apart by the slot 209.

The mononose 211 is made extremely strong to keep the tips in place. Because the mononose is flexible, bending of the tip essentially prevents the tips from slipping out.

The bindings 224, 226 may be set side-by-side or may be moved, one slightly ahead of the other. It is preferred, however, that the bindings 24, 26 be set parallel to each other, equidistant from the mononose 211 and the tail segments 217, 218. Preferred bindings are side release bindings of the safety type. They should be set 30 to 40% looser than is the usual practice.

In test falls, a skier has been found to come down without discomfort in a sitting position. It is believed that this is due to the characteristics of the twinskis in unusual attitudes, and the weight of the skier is essentially towards the rear.

Figure 19:
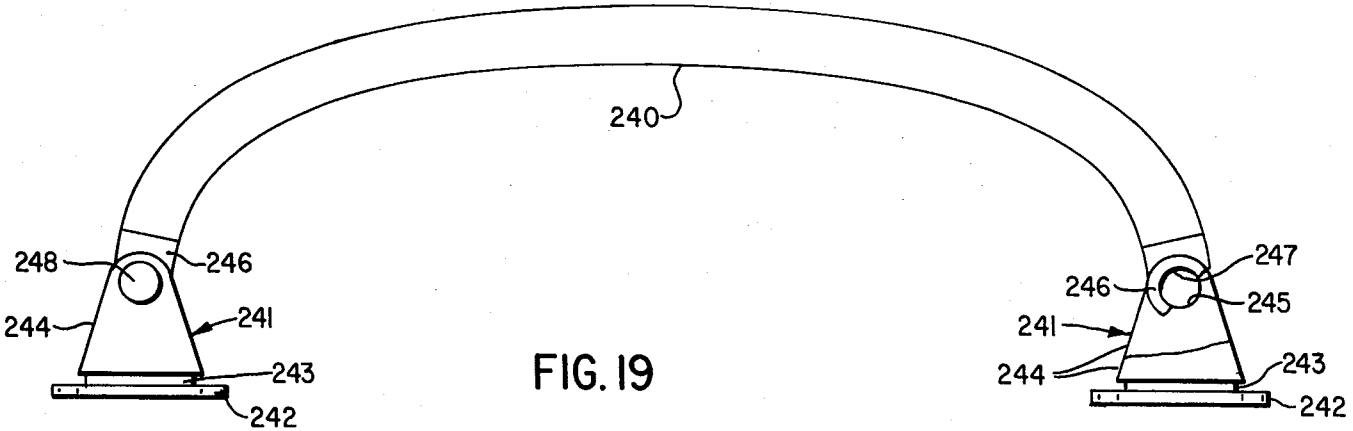
FIG. 19 is a rear end elevational view of one variant of a tail bridge structure used in the monoski conversion according to an aspect of this invention.
Figure 20:
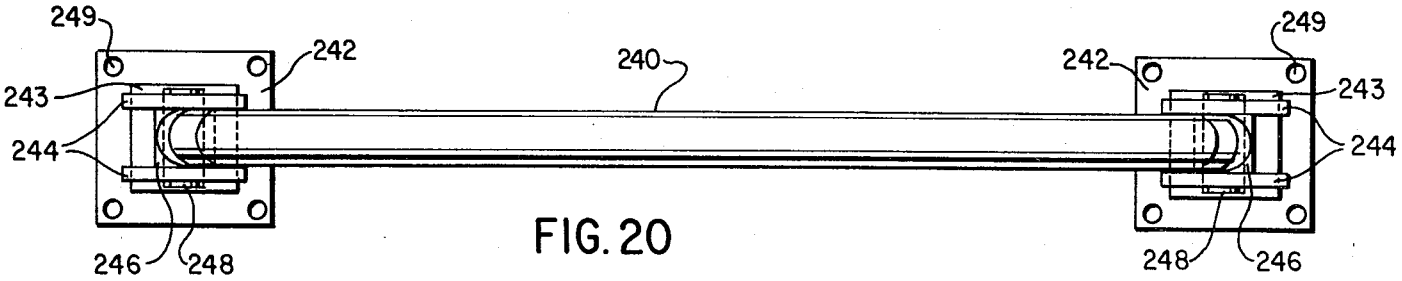
FIG. 20 is a top plan view of the tail bridge structure of FIG. 19.

(viii) Description of FIGS. 19 and 20

Turning now to FIGS. 19 and 20 the tail bridge structure 219 comprises a curved tensile steel bar 240 disposed between two retaining members 241. Each retaining member includes a generally rectangular base plate 242 having a support base pedestal 243 thereon. Upstanding from pedestal 243 are a pair of spaced apart lugs 244 provided with aligned apertures 245. The end plugs 246 of bar 240 are also provided with apertures 247. A hinge pin 248 is mounted through aperture 247, 245 to provide a hinged connection between the base 242 and the bar 240, to allow "floating" interconnection. Base plates 242 are provided with fastening apertures 249 to permit securement of the base plates 242 to the tail segments 17, 18 of the twinski 210.

Figure 21:
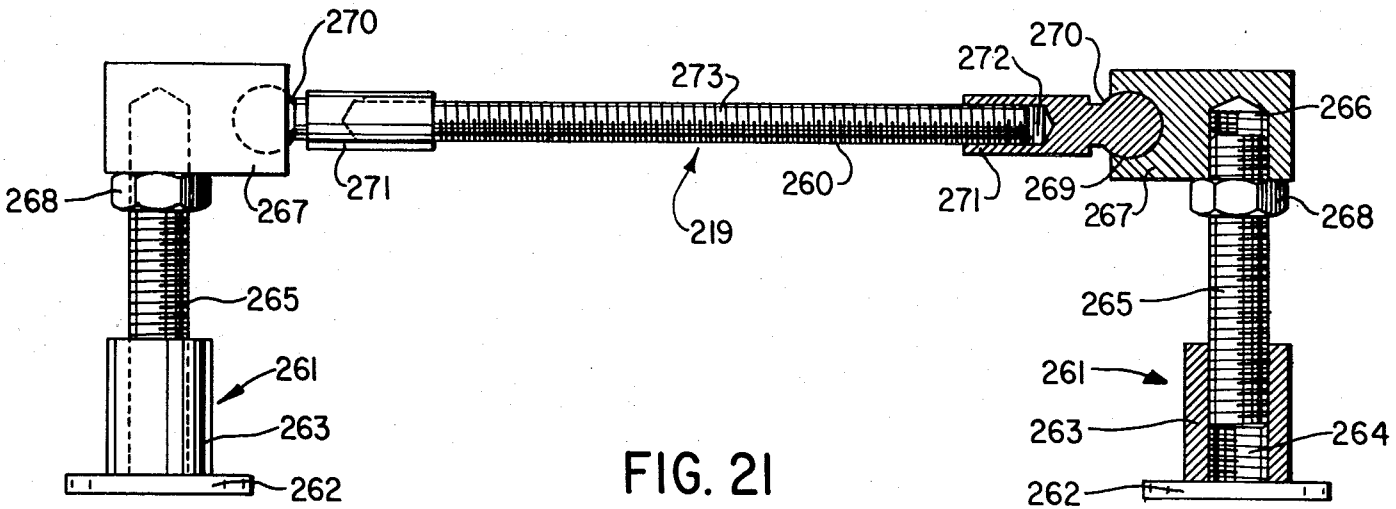
FIG. 21 is a rear end elevational view of another variant of the tail bridge structure used in the monoski conversion of another aspect of this invention.
Figure 22:
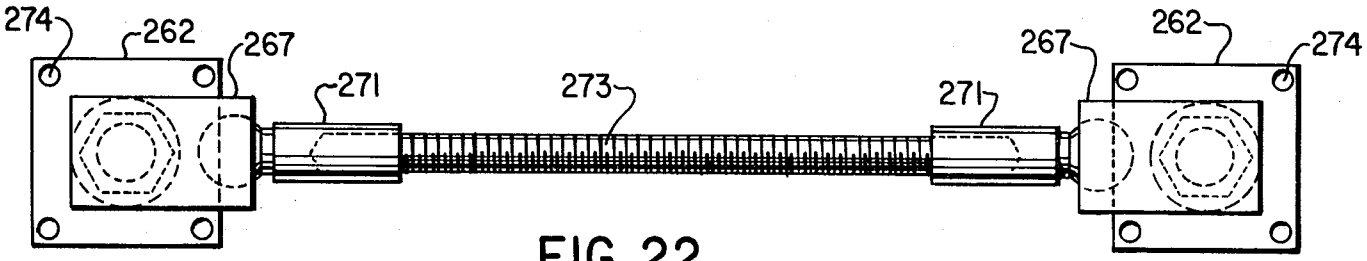
FIG. 22 is a top plan view of the tail bridge structure of FIG. 21.

(ix) Description of FIGS. 21 and 22

Turning now to FIGS. 21 and 22, the second variant of a tail bridge structure 19 is shown. It includes a horizontal bar structure 260 and a pair of vertical pedestal structures 261. Each pedestal structure includes a plate 262 with an upstanding cylindrical column 263 provided with an internally tapped bore 264. A threaded post 265 is threadedly secured to bore 264 and to an internally tapped bore 266 in a universal 90 degree connection 267. The effective height of post 265, i.e. the vertical distance between the bottom of plate 262 and the top of connector 267 is controllably adjusted by nut 268.

90 degree universal connector 267 is provided with a spheroidal cup 269 in which a ball-joint 270 of a hollow connecting rod 271 is disposed. Rod 271 is provided with an internally tapped bore 272. Universal connectors 267, connecting rods 271 and a threaded bar 273 constitute the horizontal bar structure 260. The span between the ends of connectors 267 is adjustably controlled by threading bar 73 into tapped bores 272. Base plates 62 are provided with fastening apertures 274 to permit securement of the base plates 262 to the tail segments 217, 218 of the twinski 10.

The ratio of the length of the mononose portion to the twintail portions generally is 1:5 to 1:6.5, although other proportions are permissible within aspect of this invention. The width of the slot 209 varies between $\frac{1}{4}$ and $\frac{3}{4}$ of the total average width of the twinski 210. Thus, the slot 9 may be a wider, the same width or narrower than the width of each of the tail segments 217, 218.

Figure 23:
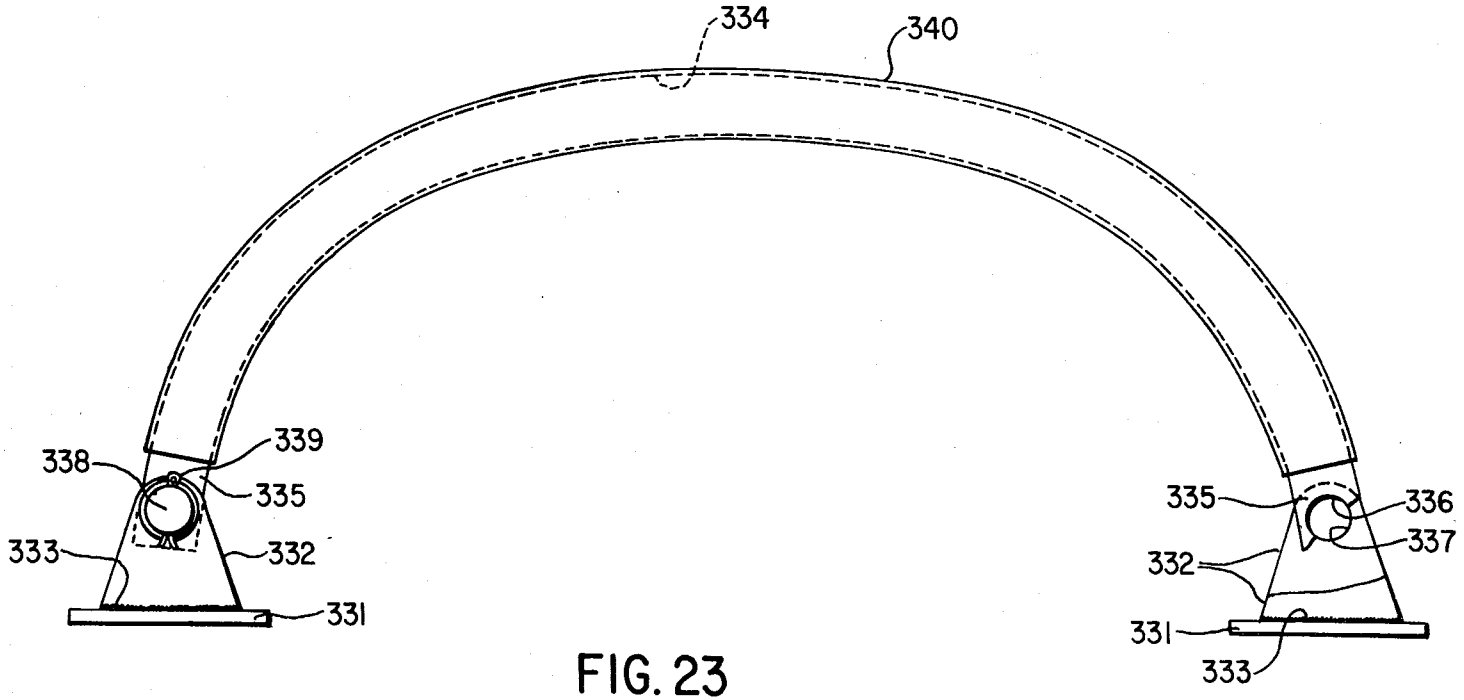
FIG. 23 is a rear end elevational view of one variant of an assembled bridge used in the monoski conversion of an aspect of this invention.
Figure 26:
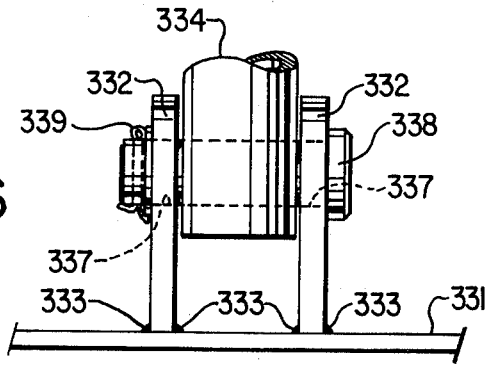
FIG. 26 is a side elevation showing one version of the assembly of the bridge to the ears.

(x) Description of FIGS. 23 and 26

As seen in FIGS. 23 and 26, the tail bridge section includes a pair of top plates 331, to each of which a pair of spaced apart ears 332 are integrally provided, e.g. by welding 333. The tail bridge means comprises a circular rod 334, bent into a semi-hoop shape, the ends 335 of which are each provided with an aperture 336. The ears are provided with aligned apertures 337. A pin 338 passes through apertures 337, 336 to secure the tail bridge means 134 to the ears 332. The pin 338 is held in place with a washer/cotter pin arrangement 339.

Figure 24:
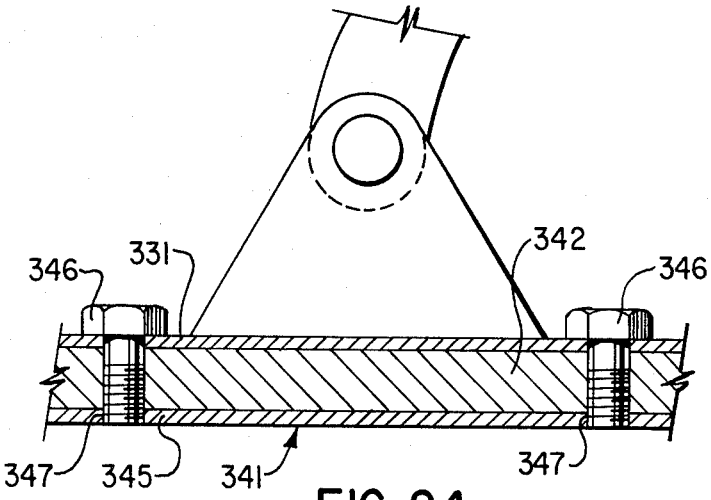
FIG. 24 is a view of a portion of a bridge section of FIG. 23 showing the securement of an upper plate to the rear end of a ski.

(xi) Description of FIG. 24

As seen in FIG. 24, the tail segment 341 of each of the conventional skis is provided with a top plate 331, secured to the ski core 342, where a section of the upper skin 343 of the ski has been removed. (See FIG. 25) A section of the lower skin 344 has also been removed to provide means for insertion of a bottom plate 345. A bolt 346 securing the top plate 131 to the bottom plate 145 passes through the ski core 142 and engages in tapped holes 347 in the bottom plate.

Figure 25:
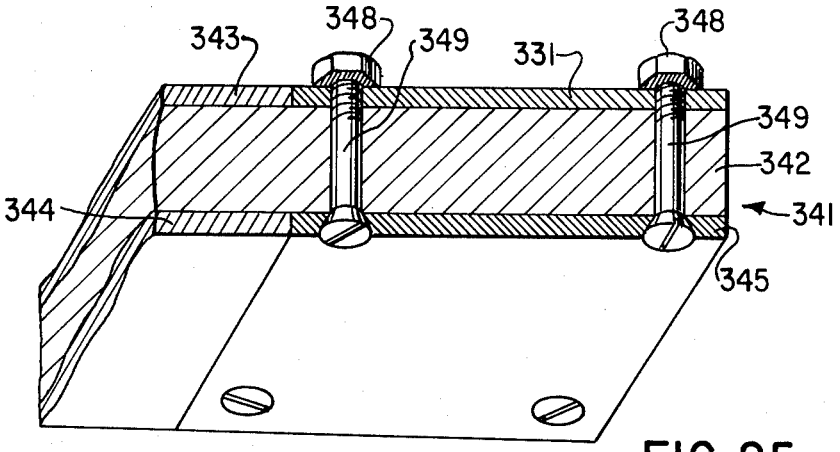
FIG. 25 is a bottom perspective view of the tail of one ski showing one version of assembly of the upper and lower plates.

(xii) Description of FIG. 25

As an alternative procedure for securing the lower plate 345 to the upper plate 331 as seen in FIG. 25, the upper plate is provided with welded-on nuts 348. A screw 349 passes through countersunk holes in the bottom plate 345 to be secured in the nuts 348.

Figure 27:
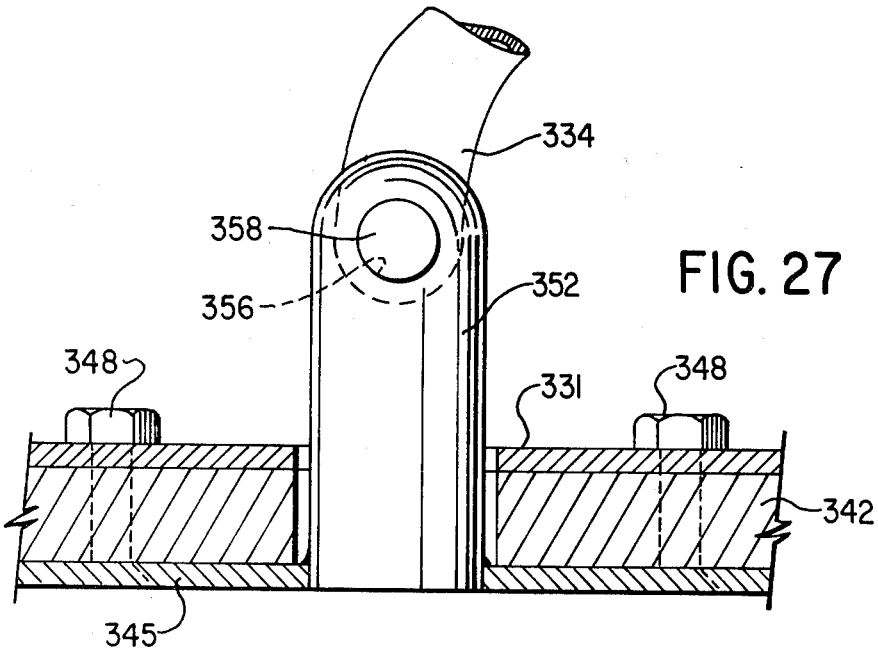
FIG. 27 is a rear end elevational view of a portion of a bridge section used in the monoski conversion of an aspect of this invention.
Figure 28:
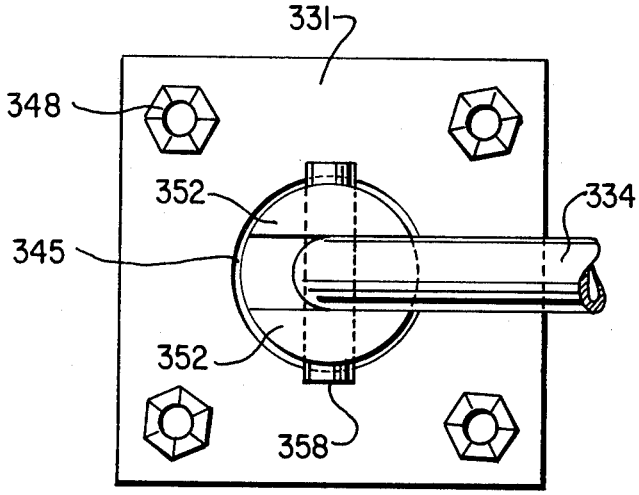
FIG. 28 is a top plan view of the bridge section of FIG. 27.

(xiii) Description of FIGS. 27 and 28

A further variation is shown in FIGS. 27 and 28. Here the bottom plate is provided with a pair of ears 352 provided with aligned apertures 356 in the same manner as ears 332. The ears 352 pass through apertures 353 in the upper plate 331. The lower end of bridge means 334 is secured to ears 352 by means of pin 358. The upper plate 131 is provided with suitable lock-nuts 348, made of fiber material, or any other suitable crown nut.

SUMMARY

The twinski is simple to ride with both feet held fairly close on the twinski 10 and there is no tendency for the feet to separate and get out of control in extreme manoeuvers. Very tight pivot turns can be made at substantially any speed without any substantial loss of stability. The turning radius can be as little as one third of that possible with conventional skis. The wide area enables the twinski 10 to plane effectively and to ride high in soft snow, which also facilitates maneuvering. In a fall, the risk of injury is greatly reduced, since the feet do not fly in different directions, each with a long unwieldly ski attached.

Thus by the present invention a twinski is provided which is fabricated from a mononose, a pair of conventional skis and a bridge section. The twinski is adapted to hold both feet in fairly close side-by-side position in conventional bindings or boot retainers. The mononose section secures the pair of skis together at the tips in a manner which still permits flexing. The "floating" interconnection of the tail sections is also important. This permits each of the bifurcated tail sections to move vertically independently. Moreover, the rear spacing of the tail section is adjustable.

Advantages of the twinski provided herein are extremely good maneuverability, good pivot turnability, controlled turns at all speeds, good support on powder snow and excellent maneuverability in both packed and corn snow. The four edges provide greater control (as in conventional skis) but the twinski provides a wider stance for balance enabling greater use by a novice. The interconnected tail sections work independently. Moreover, the ski is light and easy to carry.

From the foregoing description, one skilled in the art can easily ascertain the essential characteristics of this invention, and without departing from the spirit and scope thereof, can make various changes and modifications of the invention to adapt it to various usages and conditions. Consequently, such changes and modifications are properly, equitably, and "intended" to be, within the full range of equivalence of the following claims.

I claim:

1. A tip structure for converting a pair of conventional skis into a twinski, said tip structure comprising: a mononose section including a trailing portion of essentially the total width selected for the width of the twinski and a leading portion converging forwardly in a generally curved nose; a right-hand pocket and a left-hand pocket separated by a central bridge section, the right-hand pocket having at least a lateral outside surface defined by a forward web section adapted to conform and butt against the outside edge of the tip of a conventional ski placed in said right-hand pocket, and having an inside edge of said central bridge section adapted to conform and butt against the inside edge of the tip of a conventional ski placed in said right-hand pocket; said left-hand pocket having at least a lateral outside surface defined by a forward web section adapted to conform and butt against the outside edge of the tip of a conventional ski placed in said left-hand pocket, and having an inside edge of said central bridge section adapted to conform and butt against the inside edge of the tip of a conventional ski placed in said left-hand pocket; and means, cooperating with and associated with said mononose and with said pair of conventional skis for clamping the tips of said conventional skis rigidly to said mononose.

2. The tip structure of claim 1 in the form of a base plate and an upper plate superposed on, secured to, and comforming in size to said base plate.

3. The tip structure of claim 2 wherein said central bridge section, said base plate and said upper plate are integral.

4. The tip structure of claim 2 wherein said upper plate and said base plate are joined along their outside edges by an edge section.

5. The tip structure of claim 2 including friction means along the inner surfaces of said upper and said base plates to assist in retaining the tips of said conventional skis therein.

6. The tip structure of claim 5 including screws securing said conventional skis to said mononose.

7. The tip structure of claim 2 wherein said upper plate is secured to said base plate after said skis have been placed in said pockets.

8. The tip structure of claim 7 including a pivotal arm secured to said tail section of said base plate and adapted to be rotated to hold said tips of said conventional skis within said pockets prior to having said upper plate secured to said base plate.

9. The tip structure of claim 7 including pins projecting through aligned apertures in said base plate, said conventional skis and said upper plate, and means to retain said pins in position, thereby to secure said conventional skis to said mononose.

10. The tip structure of claim 2, including steel edges along the outer edges of said base plate.

11. The tip structure of claim 2 formed of a high impact plastics material.

12. The tip structure of claim 11 formed of injection molded high impact polyurethane.

13. The tip structure of claim 2 formed of a light weight strong metal.

14. The tip structure of claim 13 formed of aluminum.

15. In combination with the tip structure of claim 1, the provision of bridge means, secured to, and joining, the tail sections of said pair of conventional skis together, said bridge means at said tails adjustably and floatingly holding said tail segments in predetermined spaced apart relation, so that lateral spacings are predetermined, but yet the tails are permitted to move vertically, thereby converting said pair of conventional skis into a twinski.

* * * * *